US005114545A

United States Patent [19]

Alcorn et al.

[11] Patent Number: 5,114,545

[45] Date of Patent: May 19, 1992

[54] ELECTROLYTE CHEMISTRY FOR IMPROVED PERFORMANCE IN MODERN INDUSTRIAL ALUMINA REDUCTION CELLS

[75] Inventors: Thomas R. Alcorn, Florence; Alton T. Tabereaux, Sheffield, both of Ala.; Luke R. Trembley, Quebec, Canada

[73] Assignee: Reynolds Metals Company, Richmond, Va.

[21] Appl. No.: 716,146

[22] Filed: Jun. 17, 1991

[51] Int. Cl.[5] ..... C25C 3/06; C25C 3/18; H01B 1/06

[52] U.S. Cl. ..... 204/67; 252/521

[58] Field of Search ..... 204/67; 252/518, 521; 75/10.27

[56] References Cited

U.S. PATENT DOCUMENTS

| | | | |
|---|---|---|---|
| 2,919,234 | 12/1959 | Slatin | 204/67 |
| 3,787,300 | 1/1974 | Johnson | 204/67 |
| 3,852,173 | 12/1974 | Jacobs et al. | 204/67 |
| 3,900,371 | 8/1975 | Chaudhuri | 204/67 |
| 3,951,763 | 4/1976 | Sleppy et al. | 204/67 |
| 3,996,611 | 12/1976 | Graham et al. | 204/67 |
| 4,113,832 | 9/1978 | Bell et al. | 423/119 |
| 4,181,584 | 1/1980 | Steiger et al. | 204/67 |
| 4,230,540 | 10/1980 | Archer et al. | 204/67 |
| 4,405,433 | 9/1983 | Payne | 204/225 |
| 4,780,186 | 10/1988 | Christini et al. | 204/68 |
| 4,865,701 | 9/1989 | Beck et al. | 204/67 |
| 5,006,209 | 4/1991 | Beck et al. | 204/67 |

FOREIGN PATENT DOCUMENTS

| | | | |
|---|---|---|---|
| 458626 | 2/1975 | U.S.S.R. | 204/67 |
| 518536 | 8/1976 | U.S.S.R. | 204/67 |
| 979528 | 12/1982 | U.S.S.R. | 204/67 |
| 704308 | 9/1985 | U.S.S.R. | 204/67 |

OTHER PUBLICATIONS

Langon, B. et al., "Aluminium Pechiney 280 KA Pots", *Light Metals*, 1986.

Keinborg, M. et al, "Aluminium Pechiney 180 KA Prebake Pot From Prototype to Potline", *Light Metals*, 1982.

*Primary Examiner*—Donald R. Valentine

*Attorney, Agent, or Firm*—Alan T. McDonald

[57] ABSTRACT

A composition and method is disclosed for the production of aluminum. A modified cryolite electrolyte bath is shown comprising, by weight: 0.5 to 1.5% LiF: 0 to 2% $MgF_2$; 3 to 5% $CaF_2$ and 8 to 12% excess $AlF_3$. Also, $Al_2O_3$ in an amount of 1 to 6%; preferably 1 to 3% by weight, is present in the bath.

10 Claims, No Drawings

ELECTROLYTE CHEMISTRY FOR IMPROVED PERFORMANCE IN MODERN INDUSTRIAL ALUMINA REDUCTION CELLS

TECHNICAL FIELD

This invention relates to a new electrolyte chemistry formulation for reducing the specific energy consumption required to produce aluminum while maintaining a high level of metal productivity in large modern reduction cells that use a high excess of aluminum fluoride ($AlF_3$).

BACKGROUND OF THE INVENTION

Aluminum metal is conventionally produced by the electrolytic reduction of alumina dissolved in a molten cryolite bath according to the Hall-Heroult process. This process for reducing alumina is carried out in a thermally insulated cell or "pot" which contains the alumina-cryolite bath.

As the bath is traversed by electric current, alumina is reduced to aluminum at the cathode and carbon is oxidized to its dioxide at the anode. The aluminum thus produced is tapped off periodically after it has accumulated.

The electrolyte or bath is composed of cryolite ($Na_3AlF_6$) containing 1 to 8% alumina. Small amounts of aluminum fluoride, calcium fluoride (4 to 7%) (and sodium carbonate) are added from time to time to maintain the correct bath composition.

Other materials, such as LiF (0 to 7%) have also been added to electrolytic baths, but such baths are indicated to contain only up to 7% excess $AlF_3$.

Generally, about 7.5 KwH of electricity are required to make one pound of aluminum in this system. Also, generally the voltage drop across a "pot" or cell is 4.0 to 5.0 volts.

One well-known type of cell is known as a "prebaked" type since the carbon anodes have been baked before being put into the cell. Modern prebake cell potlines operate at from 180 to 300 kiloamperes with current efficiencies above 94% and specific energy consumption below 14 kwh/kg aluminum (6.36 kwh/lbAl).

All modern industrial aluminum reduction plants use essentially the same electrolyte chemistry—high excess aluminum fluoride ranging from 8 to 12% $AlF_3$ and containing 3 to 6% $CaF_2$. It has been demonstrated in plant tests and is generally accepted that an electrolyte chemistry using high excess $AlF_3$ contributes to increased metal productivity, i.e., high current efficiency (>94%).

Operating with a high excess $AlF_3$ chemistry requires improved process controls for the careful feeding of alumina with point feeders and closer monitoring of the cell stability/instability by means of improved computer systems.

Large modern cells operate efficiently because of (1) improved magnetic anode and cathode conductors designed to reduce undesirable magnetic fields and (2) operating with a high excess $AlF_3$ bath chemistry.

Plant production results clearly indicate that the high excess $AlF_3$ contributes to increased metal production (high current efficiency >94%) due to the reduction in the equilibrium dissolution of aluminum, sodium, and other metals into the electrolyte from the liquid cathode; consequently, this results in a reduction in the reaction between dissolved metals and $CO_2$ anode gas in the electrolyte region.

Other older-designed cells, without the more sophisticated modern alumina control technology systems found in the new large modern cells, are generally limited to operating with only 4 to 9% excess $AlF_3$ in the electrolyte due to difficulties encountered with alumina sludging at higher excess $AlF_3$ content, and reduced anode-cathode distance due to the high current density design. The metal productivity in these older cells is normally considerably lower i.e. 88 to 93% current efficiency.

Some disadvantages of cell operation with a high excess $AlF_3$ electrolyte composition include (1) Higher and more variability in the freezing point, and the corresponding operating temperatures, as the excess $AlF_3$ concentration can change rapidly in the electrolyte as a result of anode effects, etc.

(2) Increase in the vapor pressure and corresponding fluoride emissions from cells, and (3) Reduction in the electrical conductivity of industrial baths and increased bath voltage drop, i.e., higher cell voltage, due to increased $AlF_3$ content.

Modern prebake cells operate with larger anodes to reduce the anode overvoltage and reduce the anode current density to offset the higher voltage drop due to the lower bath conductivity associated with high excess $AlF_3$ electrolyte chemistry, but problems still remain.

The general operating parameters of alumina reduction cells, and the general chemistry associated with molten cryolite baths are old and well-known and no discussion thereof is needed.

DESCRIPTION OF THE PRIOR ART

There exists some prior art that contemplates the addition of Lithium Fluoride to high excess Aluminum Fluoride baths. Much of this art does not necessarily refer to the concept of high excess Aluminum Fluoride, but expresses a similar concept by the use of the term "cryolite ratio" or "weight ratio of Sodium Fluoride to Aluminum Fluoride". Cryolite can be written as $3NaF.AlF_3$ rather than $Na_3AlF_6$. Taking into account molecular weight, cryolite can be calculated to contain 60 percent NaF and 40 percent $AlF_3$. Consequently, the "weight ratio" or "cryolite ratio" of pure cryolite is 60% NaF divided by 40% $AlF_3$ or a ratio of 1.5. It is seen that any weight ratio of less than 1.5 indicates the presence of excess $AlF_3$ added to the cryolite bath. A method for calculating excess $AlF_3$ in an electrolysis bath is given by the following series of formulas:

$$\%\ \text{Cryolite} = [100 - (\%CaF_2 + \%MgF_2 + \%LiF + \%Al_2O_3)] \quad (1)$$

$$\text{Total } \%\ AlF_3 = \left[\frac{\%\ \text{Cryolite}}{1 + \text{Ratio}}\right] \text{where,} \quad \text{Eq. 2}$$

$$\text{Ratio} = \text{weight ratio}$$

$$\text{Total } \%NaF = (\%\ \text{Cryolite} - \text{Total } \%\ AlF_3) \quad (3)$$

$$\% \text{ Excess } AlF_3 = \left[ \text{Total } \% \ AlF_3 - \frac{\% \ NaF}{1.50} \right] \quad \text{Eq. 4}$$

Jacobs et al. in U.S. Pat. No. 3,852,173, disclose an electrolyte bath consisting essentially of $Al_2O_3$, NaF and $AlF_3$, having a weight ratio of NaF to $AlF_3$ up to 1.1 to 1. Materials such as LiF, $CaF_2$ and $MgF_2$ can be used, with LiF in an amount between 1 and 15 wt. percent indicated as preferred. Preferably, a bath weight ratio NaF to $AlF_3$ is less than 1.

Thus, an excess of $AlF_3$ is contemplated by Jacobs. The publication contemplates adding LiF in order to lower the liquid temperature of NaF−$AlF_3$ fused salt mixture serving as cryolite in order to prevent bath crusting. Examples 5, 6 and 7 of the Jacobs patent show the presence of LiF:

TABLE I

| | Example 5 | Example 6 | Example 7 |
|---|---|---|---|
| $MgF_2$(%) | 0.38 | 0.28 | — |
| $Al_2O_3$(%) | 4.09 | 4.00 | 4 to 5 |
| LiF(%) | 5.61 | 10.165 | 5 |
| $AlF_3$(%) | 48.97 | 45.08 | 50* |
| NaF(%) | 38.13 | 36.94 | 40* |
| $CaF_2$(%) | 3.11 | 3.17 | — |
| Weight Ratio NaF/$AlF_3$ | 0.78 | 0.82 | 0.8 |
| Bath Temp (°C.) | 900 | 898 | 910 |
| % Excess $AlF_3$ | 23 | 20.4 | 23* |
| % Efficiency | 92.6 | 90.0 | — |
| kwh/kgAl | 16.45 | 17.07 | — |
| kwh/lbAl | 7.47 | 7.76 | — |

*Calculated using formulas given above

It is therefore apparent that Jacobs contemplates use of $AlF_3$ far in excess of the 8 to 12% of the electrolyte herein, and contemplates far larger amounts of LiF.

Graham, in U.S. Pat. No. 3,996,117, describes an electrolyte bath as being predominantly NaF and $AlF_3$, containing $CaF_2$ and $Al_2O_3$, covered with a frozen crust, and containing 5 to 10 weight percent of LiF while maintaining a weight ratio of NaF to $AlF_3$ of 1.04 to 1.15. The data given in Examples 1, 3, 4, 5 and 6 of the patent is tabulated in Table 2.

TABLE II

| | I | III | IV | V | VI |
|---|---|---|---|---|---|
| Volts | | 5.24 | 5.35 | 5.44 | 5.34 |
| $CaF_2$(%) | 3.5 | 3.6 | — | 3.66 | 3.46 |
| $Al_2O_3$(%) | 3.5 | 3.99 | — | 2.97 | 3.90 |
| $AlF_3$(%) | 40 | 39.8 | — | 41.8 | 41.9 |
| LiF(%) | 10 | 9.5 | 7.05 | 5.08 | 6.47 |
| NaF(%) | 42.5 | 42.03 | — | (47.7)* | (46.9)* |
| $MgF_2$(%) | .25 | .25 | — | .35 | .27 |
| Cryolite ratio | 1.06 | 1.06 | 1.08 | 1.14 | 1.12 |
| % Excess $AlCl_3$ | 11.77* | 11.87* | — | 10.0* | 10.6* |
| Bath T(°C.) | 930 | — | 938 | 939 | — |
| % Efficiency | — | 89.7 | 93.7 | 87.9 | 89.8 |
| kwh/lb/Al | — | 7.9 | 7.72 | 8.37 | 8.65 |

The numbers indicated by asterisks were calculated using the formulas above. Graham does contemplate an excess of $AlF_3$ within the concept of the bath herein, but contemplates far larger amounts of LiF.

Payne (U.S. Pat. No. 4,405,433) describes a mechanical improvement in cell structure. In the Payne patent, an electrolytic bath is described as comprising:

| | |
|---|---|
| $CaF_2$ | 3.1% by weight |
| $MgF_2$ | 8.0% by weight |

-continued

| | |
|---|---|
| LiF | 8.0% by weight |
| NaF | 44.4% by weight |
| $AlF_3$ | 32.9% by weight |
| $Al_2O_3$ | 3.6% by weight |

$$\text{Bath Ratio } \frac{NaF}{AlF_3} = 1.35$$

By applying the formulas given above, it can be calculated that there is 3.3% excess $AlF_3$, which is not within the concept expressed herein. Also, the bath contains 8.0% LiF.

Beck, in U.S. Pat. No. 4,865,701, describes two baths:

TABLE III

| Ingredient | Bath A | Bath B |
|---|---|---|
| $Na_3AlF_6$ | 38% | 24% |
| $AlF_3$ | 41% | 52% |
| LiF | 21% | 24% |

Hence, extremely large excesses of $AlF_3$ are contemplated, as well as extremely large amounts of LiF. The patent states that baths of the type described permit operation of Hall-Heroult cells at low temperatures, preferably below 750° C.

Keinborg et al., in a technical paper entitled "Aluminum Pechiney 180 kA Prebake Pot from Prototype to Potline," (Light Metals 1982, AIME Annual Meeting, Dallas, Tex., page 449), describe the operation of cells which they describe as containing 12 to 13% excess $AlF_3$. They state that lithium additions were made to one pot but failed to yield any improvement and the addition was discontinued. The specific nature of the Lithium compound and the amount are not given. It appears that these authors found a decrease in cell efficiency with no reduction in cell voltage.

Longon et al. in "Light Metals 1986, AIME Annual Meeting, New Orleans, La., page 343", show, at page 346, the addition of LiF to baths containing excess $AlF_3$.

TABLE IV

| | Bath 1 | Bath 2 | Bath 3 | Ref. |
|---|---|---|---|---|
| LiF % | 2.6 | 3.0 | 2.1 | 0.4 |
| Excess AlF3 % | 7.7 | 9.5 | 11.2 | 12.5 |
| Temperature °C. | 953 | 942 | 937 | 952 |
| Current efficiency % | 91.9 | 94.1 | 95.1 | 95.8 |
| Voltage V | 4.11 | 4.13 | 4.16 | 4.13 |
| Kwh/MTAl | 13,320 | 13,060 | 13,030 | 12,840 |
| Kwh/lbAl | 6.04 | 5.92 | 5.92 | 5.82 |

Longon et al conclude that since the data indicated a decrease in current efficiency with no reduction in cell voltage, the addition of Lithium could not be justified since current efficiency exceeding 95% could be achieved without it.

It is clear that the prior art, to the extent they encompass the addition of LiF to cryolite baths containing excess $AlF_3$, do not disclose the composition described herein.

The prior art invariably adds amounts of LiF far in excess of the material herein, with the exception of Longon, who concludes that addition of LiF is not warranted.

OBJECTS OF THE INVENTION

It is an object of this invention to provide a novel electrolyte bath composition to improve the performance of alumina reduction cells.

It is a further object of this invention to provide a novel electrolyte bath composition which can be used in any modern day aluminum production process without material alteration of production facilities.

It is a still further object of this invention to provide a novel electrolyte bath composition that lessens the production of environmental contaminatants such as fluorine.

It is another object of this invention to provide a novel electrolyte bath which produces aluminum of even greater purity than that currently produced by Hall-Heroult cells. This results from the increased cell stability due to the increased electrical conductivity of the electrolyte and consequential increase in the anode-cathode distance.

It is a further object of this invention to provide a novel electrolyte bath which produces aluminum at lower electrical cost and lower raw material cost by providing a highly efficient system and a method for the production of aluminum using the novel electrode bath.

Other objects and advantages of the invention will become apparent as the description thereof proceeds.

DISCLOSURE OF THE INVENTION

According to this invention, it has been found that the addition of LiF in a specified chemical composition range is sufficient to provide a substantial increase in the electrical conductivity of the high excess $AlF_3$ cryolytic bath and result in a 50 to 100 mV reduction in the cell voltage, or 5% reduction in the cell specific energy consumption. This LiF addition maintains the high metal productivity (>94% current efficiency) associated with high excess $AlF_3$ electrolyte composition. The overall chemical composition is adjusted to provide optimum bath properties (i.e., bath freezing point, density, conductivity, etc.).

This new electrolyte composition provides both (1) high metal productivity/current efficiency >94% and (2) lower cell voltage operation/lower cell specific energy consumption. The new industrial electrolyte comprises the following chemical composition by weight:

| Component | Amount |
|---|---|
| LiF | 0.5–1.5% |
| $MgF_2$ | 0.0–2.0% |
| $CaF_2$ | 3.0–5.0% |
| $AlF_3$ | 8.0%–12.0% excess |

About 1 to 6 percent $Al_2O_3$ is present in the bath, and the remainder of the bath composition is essentially all cryolite.

A particular advantage of the present invention is that conventional Hall-Heroult cell construction can be used for the process described. All that is necessary is that the bath chemistry be adjusted to conform to the present invention and that electrical current and voltage be adjusted to produce the most favorable results. No changes are required in cell structure, and as a consequence normal standard operating procedures, of the type generally shown by the prior art and standard methods are adequate.

Although the amount of $Al_2O_3$ can range as high as 6%, it is conventional in modern day prebaked electrode electrolyte cell chemistry to maintain a concentration of about 1 to 3% $Al_2O_3$. Improvements in cell technology and computer controlled $Al_2O_3$ addition to the molten electrolyte allow the use of lower concentrations of $Al_2O_3$ in order to prevent various detrimental effects that result due to the presence of excess amounts of $Al_2O_3$.

As a general rule, cryolite is the main component of the bath. It is possible to prepare cryolite in the electrolyte cell by adding NaF and $AlF_3$ in the proper proportions and melting the mix, but such is not the preferred method of operation. It is necessary, however, to add NaF and $AlF_3$ during operation in order to maintain the proper excess of $AlF_3$ and to maintain the proper bath ratio.

The given amounts of LiF, $MgF_2$ and $CaF_2$, as well as careful monitoring of the amount of excess $AlF_3$ are important elements of the invention. Departure from the amounts given results in a bath having undesirable characteristics.

Small amounts of $Li_2CO_3$, can be present, but its presence is not required. Very small amounts of $Li_2CO_3$ have conventionally been added to prior art high excess $AlF_3$ cells, but its presence is never required.

In calculating the amounts of LiF to be added to any specific bath, the amount of naturally present LiF must be determined and taken into account. Amounts of LiF up to a total of 0.3% can be naturally present in the starting materials.

DESCRIPTION OF PREFERRED EMBODIMENTS

Conventional modern Hall-Heroult prebaked electrode reduction cells were operated under conventional conditions. The electrolyte bath components were added together as normally done, but some of the baths were modified by the introduction of LiF. The results are shown in Tables V and VI.

TABLE V

COMPARISON OF HIGH EXCESS ALUMINUM FLUORIDE AND LITHIUM MODIFIED-HIGH EXCESS ALUMINUM FLUORIDE ELECTROLYTE CHEMISTRIES

| Electrolyte Chemistry | Excess $AlF_3$ | Lithium-Modified High Excess $AlF_3$ |
|---|---|---|
| Bath Ratio | 1.12 | 1.18 |
| $Al_2O_3$, % | 2.50 | 2.50 |
| $CaF_2$, % | 4.00 | 4.00 |
| $MgF_2$, % | 0.30 | 0.05 |
| LiF, % | 0.30 (naturally occurring) | 1.00 |
| Excess $AlF_3$, % | 11.07 | 10.00 |
| Bath Temperature, °C. | 955 | 955 |

TABLE VI

| Electrolyte Properties | High Excess $AlF_3$ | Lithium-Modified $AlF_3$ | Change in Percent |
|---|---|---|---|
| Freezing Point, °C. | 948 | 945 | −0.3 |
| Density, g/cm$^3$ | 2.114 | 2.120 | +0.3 |
| Electrical Conductivity, mho/cm | 2.03 | 2.10 | +3.4 |
| Alumina Solubility, % | 6.24 | 6.32 | +1.3 |
| Bath Vapor Pressure, Torr | 4.35 | 3.73 | −14.3 |
| Typical Cell | 4.212 | 4.152 | −1.4 |

TABLE VI-continued

| Electrolyte Properties | High Excess $AlF_3$ | Lithium-Modified $AlF_3$ | Change in Percent |
|---|---|---|---|
| Voltage, volts | | | |
| Typical Current Efficiency, % | 94.8% | 94.8% | 0 |

Operating a potline of modern 180 kA prebake reduction cells using the new lithium-modified high excess $AlF_3$ electrolyte composition results in:

(1) Significant eduction in the cell voltage, about 0.050 to 0.100 volt.

(2) Significant reduction in the cell specific energy consumption, about 1-2%.

(3) Significant improvement in the cell voltage or resistance stability as indicated by computer control systems.

(4) Lower and more consistent electrolyte bath freezing points and corresponding cell operating temperatures.

(5) No change in the normal cell operational practices: metal tapping, anode changing, anode effects, etc.

(6) Reduction in the fluoride emissions due to reduction in the bath vapor pressure.

EXAMPLE

A line of cells, referred to as a "pot line" of the prebaked electrode type was operated. One group of cells contained no LiF or $MgF_2$ (High Excess $AlF_3$ cells) while a second group was operated with one percent LiF, and one percent $MgF_2$ (Lithium modified cells). The following table presents the data obtained:

TABLE VII

Pot Line Production - Consumption Data (One Year)

| | High Excess $AlF_3$ | Lithium Modified High Excess $AlF_3$ | Difference Percent |
|---|---|---|---|
| Current Efficiency, % | 94.47 | 94.27 | −0.21 |
| Volts/Cell | 4.21 | 4.17 | −0.95 |
| KWH/kg. Al DC | 13.28 | 13.18 | −0.75 |
| KWH/kg. Al AC | 13.47 | 13.37 | −0.74 |
| Kg Fluorine/ Kg. Al | 0.137 | 0.123 | −10.22 |
| Kg. Cryolite/ Kg. Al | 0.001 | 0.0002 | −80.00 |
| Kg. AlF3/3Kg. Al | 0.023 | 0.0216 | −6.09 |
| Kg. Li2CO3/ Kg. Al | 0 | 0.0009 | — |
| Kg. Carbon/KgAl (gross) | 0.581 | 0.575 | −1.03 |
| Kg. Carbon/ KgAl (net) | 0.397 | 0.405 | +2.02 |
| Excess $AlF_3$, % | 11 | 9.7 | −11.82 |
| NaF/AlF3 Ratio | 1.15 | 1.18 | +2.61 |
| $CaF_2$, % | 4.5 | 4.15 | −7.78 |
| LiF, % | 0 | 1 | — |
| $MgF_2$, % | 0 | 1 | — |
| Bath Temperature, °C. | 956 | 956 | 0.00 |
| Iron Impurity, % | 0.15 | 0.14 | −6.67 |
| Silicon Impurity, % | 0.037 | 0.03 | −18.92 |

The major points of the test demonstrate:

1. Reduction in the voltage, 4.21 compared with 4.17 volts per cell, (1.0% reduction)

2. The same high level of metal production was retained.

94.47 compared with 94.27% current efficiency, (only 0.2% difference)

3. A decrease in the cell energy consumption, 13.47 compared with 13.37 AC KWH/Kg Al, (6.12 KWH/lbAl), (0.74% reduction)

13.28 compared with 13.18 DC KWH/Kg Al, (6.06 KWH/lbAl), (0.75% reduction)

There were several other favorable aspects of the lithium modified operation:

1. 10% reduction in fluorine consumption.
2. 80% reduction in the cryolite consumption.
3. 6% reduction in the $AlF_3$ consumption.
4 Slight improvement in the iron and silicon impurity content of the metal tapped from the cells.

Note that the 9.7% excess $AlF_3$ content in the lithium modified cells is lower than that for the original high excess $AlF_3$ cells, 11.0%. This was found to be more ideal for the operation of the cells, to maintain the same bath freezing point, and thus the same bath operating temperature at the same point, 956° C.

A comparison of the most pertinant results obtained from the tests, and the results obtained from prior art data, i.e. U.S. Pat. Nos. 3,852,173 and 3,996,117 and the Langon paper incorporating LiF in high excess $AlF_3$ cells is given in Table VIII.

TABLE VIII

| | High Excess $ALF_3$ | Li-Modified High Excess $ALF_3$ | U.S. Pat. No. 3,852,173 Jacobs | U.S. Pat. No. 3,996,117 Graham | Langon |
|---|---|---|---|---|---|
| KWH/lb/Al | 6.04 | 6.00 | 7.45-7.76 | 7.72-8.36 | 5.82-6.04 |
| Volts | 4.21 | 4.17 | 5.13-5.47 | 5.24-5.44 | 4.11-4.16 |
| % Efficiency | 94.47 | 94.47 | 90-92.6 | 87.9-93.7 | 91.9-95.8 |
| Temperature | 956 | 956 | 900-910 | 930-940 | 937-953 |

It can be seen that electrolyte baths within the concept of the present invention are more efficient than those described in the Jacobs and Graham patents and compare favorably with the results obtained by Langon et al. who teach experimental pots and methods and wherein closer process control due to the experimental nature of their production facilities would give results better than those normally obtained in large commercial production facilities. The data obtained by Langon indicates considerable variability in current efficiency with small changes in bath composition, a situation which would be detrimental in large scale aluminum production, and which does not occur with the electrolytic baths of the present invention.

It can be further seen that in comparison with the high excess $AlF_3$ electrolyte baths not containing material amounts of LiF (the type generally used in modern day aluminum production), a small but definite lessening of the amount of electricity to produce 1 pound of aluminum, at lower cell voltage, with no drop in % efficiency is achieved. This improvement taken with regard to the total aluminum production facilities operating today indicate that the objects of the invention have been achieved.

We claim:

1. In a process for producing aluminum metal which process includes electrolytically decomposing alumina to aluminum metal in a molten electrolyte bath, the bath being predominantly cryolite, the improvement wherein the bath comprises in parts by weight, 0.5 to 1.5% LiF, 0-2.0% $MgF_2$ 3.0 to 5.0% $CaF_2$, and 8.0 to 12.0% excess $AlF_3$.

2. In a process for producing aluminum metal, which process includes decomposing alumina to aluminum metal in a molten electrolyte bath, the bath being predominantly cryolite, the improvement wherein the bath comprises 1 to 6.0% $Al_2O_3$; 0.5 to 1.5% LiF; 0–2.0% $MgF_2$, 3.0 to 5.0% $CaF_2$; 8.0 to 12.0% excess $AlF_3$ and the remainder essentially cryolite.

3. The process of claim 2, wherein the $Al_2O_3$ concentration is 1.0 to 3.0%.

4. An electrolytic bath for aluminum metal production comprising 0.5 to 1.5% LiF; 0–2.0% $MgF_2$; 3.0 to 5.0% $CaF_2$ and 8.0 to 12.0% excess $AlF_3$.

5. An electrolytic bath for aluminum metal production comprising 1 to 6.0% $Al_2O_3$; 0.5 to 1.5% LiF; 0–2.0% $MgF_2$; 3.0 to 5.0% $CaF_2$; 8.0 to 12.0% excess $AlF_3$ and the remainder essentially cryolite.

6. The electrolytic bath of claim 5 wherein the $Al_2O_3$ concentration is 1.0 to 3.0%.

7. In a process for producing aluminum metal, which process includes decomposing alumina to aluminum metal in a molten electrolyte bath, the bath being predominantly cryolite, the improvement wherein the bath consists essentially of 1 to 6.0% $Al_2O_3$; 0.5 to 1.5% LiF; 0–2.0% $MgF_2$, 3.0 to 5.0% $CaF_2$; 8.0 to 12.0% excess $AlF_3$ and the remainder essentially cryolite.

8. The process of claim 7 wherein the $Al_2O_3$ concentration is 1.0 to 3.0%.

9. An electrolytic bath for aluminum metal production consisting essentially of 1 to 6.0% $Al_2O_3$; 0.5 to 1.5% LiF; 0–2.0% $MgF_2$; 3.0 to 5.0% $CaF_2$; 8.0 to 12.0% excess $AlF_3$ and the remainder essentially cryolite.

10. The electrolytic bath of claim 9 wherein the $Al_2O_3$ concentration is 1.0 to 3.0%.

* * * * *